US006299161B1

(12) United States Patent
Kang

(10) Patent No.: US 6,299,161 B1
(45) Date of Patent: Oct. 9, 2001

(54) APPARATUS FOR GUIDING A PAPER IN A PRINTER

(75) Inventor: Nae-Wan Kang, Kyonggi-do (KR)

(73) Assignee: SamSung Electronics Co., Ltd., Suwon-City (KR)

( * ) Notice: Subject to any disclaimer, the term of this patent is extended or adjusted under 35 U.S.C. 154(b) by 0 days.

(21) Appl. No.: 09/195,986

(22) Filed: Nov. 19, 1998

(30) Foreign Application Priority Data

Nov. 20, 1997 (KR) ..... 97 33024

(51) Int. Cl.[7] ..... B65H 9/00

(52) U.S. Cl. ..... 271/240; 271/239; 271/272; 271/264; 271/314

(58) Field of Search ..... 271/272, 264, 271/314; 242/615; 226/196.1

(56) References Cited

U.S. PATENT DOCUMENTS

| | | | | |
|---|---|---|---|---|
| 4,131,358 | * | 12/1978 | Windele | 399/317 |
| 4,629,177 | * | 12/1986 | Roddeman et al. | 271/240 |
| 4,772,907 | * | 9/1988 | Marson | 396/612 |
| 5,534,902 | * | 7/1996 | Hoesly | 347/104 |
| 5,927,877 | * | 7/1999 | Kelly et al. | 400/625 |

* cited by examiner

*Primary Examiner*—Donald P. Walsh
*Assistant Examiner*—Jonathan R. Miller
(74) *Attorney, Agent, or Firm*—Robert E. Bushnell, Esq.

(57) ABSTRACT

Disclosed is an apparatus for guiding a paper for printing, which includes guide arms for guiding the paper carried between a transferring device and a fixing device. In the apparatus for guiding the paper for printing, the guide arms are mounted and spaced at a width of the paper from each other between the transferring device and the fixing device so as to guide the paper with being in contact with non-image portions of which a surface of the paper has an image formed thereon.

9 Claims, 2 Drawing Sheets

APPARATUS FOR GUIDING A PAPER IN A PRINTER

CLAIM OF PRIORITY

This application makes reference to, incorporates the same herein, and claims all benefits accruing under 35 U.S.C. §119 from an application for APPARATUS FOR GUIDING A PAPER IN A PRINTER earlier filed in the Korean Industrial Property Office on the 20$^{th}$ of November 1997 and there duly assigned Ser. No. 33024/1997.

BACKGROUND OF THE INVENTION

1. Field of the Invention

The present invention relates to the class of devices for performing electrophotography, and more particularly to an apparatus for guiding a paper in a printer from the transfer device to the fixing unit.

2. Description of the Prior Art

Generally, in an image forming device which utilizes electrophotography, such as a printer, a copier, or a combined office automatic instrument, an apparatus is provided for guiding the paper as the paper is introduced into the fixing device after passing through the transferring device, while preserving the surface of the paper on which image is formed. In one example of an apparatus for guiding a paper, the transferring drum is on top in the transferring unit, and the paper is fed horizontally to the fixing device with the image on the upper surface of the paper. A guide wheel having an asterisk cross-section contacts the upper side of the paper to guide it to the fixing device. The friction of the guide wheel with the image side of the paper can, however, lead to damage to the surface of the paper containing the image.

In a second example of an apparatus for guiding a paper, the transferring drum is on the bottom in the transferring unit, and the paper is fed horizontally to the fixing device with the image on the lower surface of the paper. A guide wheel having an asterisk cross-section contacts the lower surface of the paper to guide it to the fixing device. Again, the friction of the guide wheel with the image side of the paper can lead to damage to the surface of the paper containing the image.

In a third example of an apparatus for guiding a paper, an electrostatic device is mounted in the printer or copier facing the surface of the paper on the opposite side from where the image is formed, so as to keep the paper from hanging down. However, the electrostatic device has a complicated structure, resulting in increasing cost of manufacturing the printer or the copier having this electrostatic device.

Based on my observation of the art, I have found that what is needed is an apparatus for guiding a paper from the transferring drum to the fixing unit which does not involve contact with the surface of the paper where the image to be fixed is formed. This apparatus for guiding a paper is mechanically simple and inexpensive.

SUMMARY OF THE INVENTION

It is therefore an object of the present invention to provide an improved paper guide for a printer.

It is another object of the present invention to provide a paper guide for a printer which does not require use of a guide wheel.

It is a further object of the present invention to provide a paper guide for a printer which does not damage the image to be fixed.

It is a yet further object of the present invention to provide a paper guide for a printer which does not contact the surface of the paper containing the image to be fixed.

It is a still further object of the present invention to provide a paper guide which is simple in operation.

It is a still yet further object of the present invention to provide a paper guide which is inexpensive to make.

The present invention has been made to overcome the above described problems of conventional printers and provides an apparatus for guiding a paper for printing, which is capable of guiding the paper without damage to the surface on which an image is formed. To accomplish the above objects of the present invention, there is provided a guiding apparatus comprising a pair of guide arms for guiding a paper which is carried from a transferring device to a fixing device, in which the guide arms are mounted between the transferring device and the fixing device and spaced roughly at a width of a paper from each other so as to be in contact with non-image portions of a surface of the paper on which an image is formed and to guide the paper. Preferably, these portions are both side edges of the surface on which the image is formed.

The guide arm includes a bracket fixed to a guide wall which is positioned over a passageway of the paper, a connecting section extended from the bracket to the surface of the paper on which the image is formed, and paper support extending from the connecting section to the edges of the surface of the paper on which the image is formed, so that the paper support is in contact with the edges of the surface.

The guide arms respectively have a plurality of the paper supports formed in parallel to each other and the paper supports have a knife edge shape to minimize the contact with the surface of the paper on which the image is formed. The paper supports preferably have an edge curved to be in correspond with the paper path, the edge being in contact with the surface of the paper on which the image is formed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
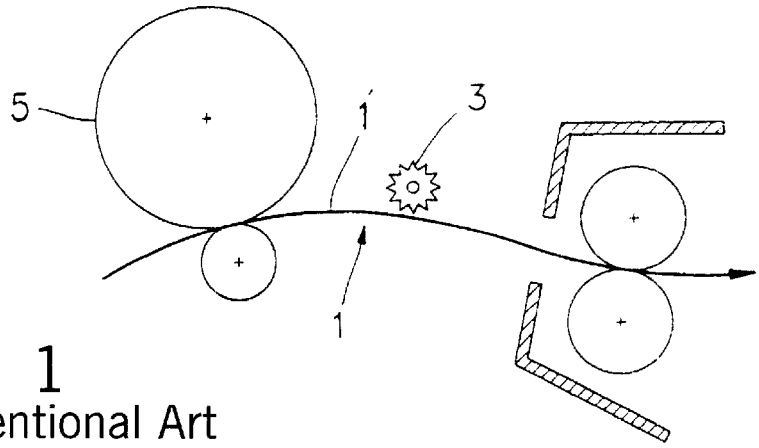
FIG. 1 Conventional Art
FIG. 1 is a vertical cross-sectional schematic view of an apparatus for guiding a paper according to the conventional art.
Figure 2:
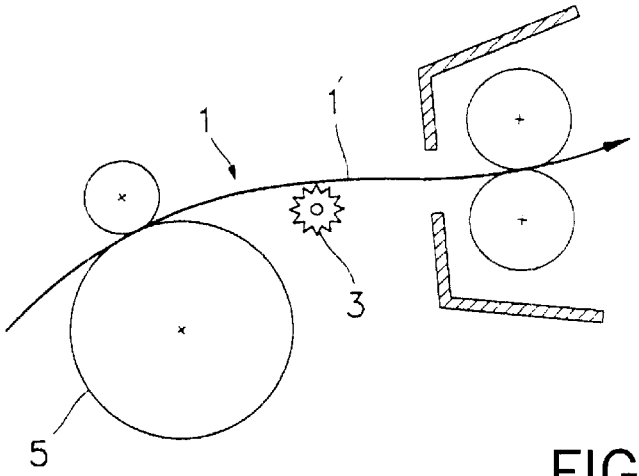
FIG. 2 Conventional Art
FIG. 2 is a vertical cross-sectional schematic view of a second apparatus for guiding a paper according to the conventional art.
Figure 3:
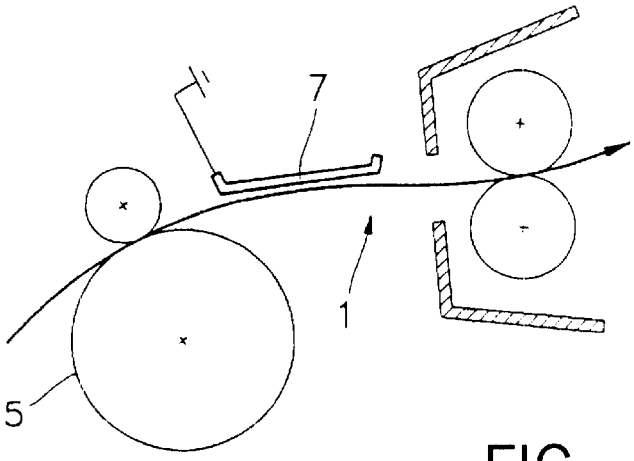
FIG. 3 Conventional Art
FIG. 3 is a vertical cross-sectional schematic view of a third apparatus for guiding a paper according to the conventional art.

FIGS. 1 to 3 show apparatus for guiding a paper according to embodiments of the conventional art. FIG. 1 shows transferring drum 5 of a transferring device which is disposed over paper 1, as paper 1 on which surface 1' has the image formed is directed from transferring drum 5 to the fixing unit. The arrowhead of paper 1 indicates the direction of movement. The apparatus for guiding 1 paper 1 includes guide wheel 3 having cross-sectional shape of an asterisk so as to minimize friction with surface 1', on which the image is formed, of paper 1. Guide wheel 3 guides paper 1 by supporting surface 1' of paper 1. This apparatus thus entails contact of guide wheel 3 with the surface of the paper on which the image is formed.

FIG. 2 shows transferring drum 5 of the transferring device disposed below paper 1, in which surface 1', which has image formed, of paper 1 is directed from transferring drum 5. The apparatus for guiding the paper includes guide wheel 3 having cross-sectional shape of an asterisk so as to minimize contact with surface 1', which has image formed, of paper 1. Guide wheel 3 guides paper 1 supporting surface 1', which has image formed, of paper 1. In an apparatus for guiding the paper 1 which has guide wheel 3 as described above, there is the problem that surface 1' of paper 1 can be damaged due to friction as guide wheel 3 supports paper 1, contacting surface 1' of the paper, on which the image is formed.

FIG. 3 shows transferring drum 5 of a transferring device which is disposed below paper 1, in which surface 1', on which the image is formed, of paper 1 is directed from transferring drum 5. As shown in FIG. 3, electrostatic device 7 is mounted in the printer or copier facing the opposite surface of paper 1 from the surface on which the image is formed, so that paper 1 is prevented from hanging down. Such an electrostatic device is complex and expensive to include in a printer.

Figure 4:
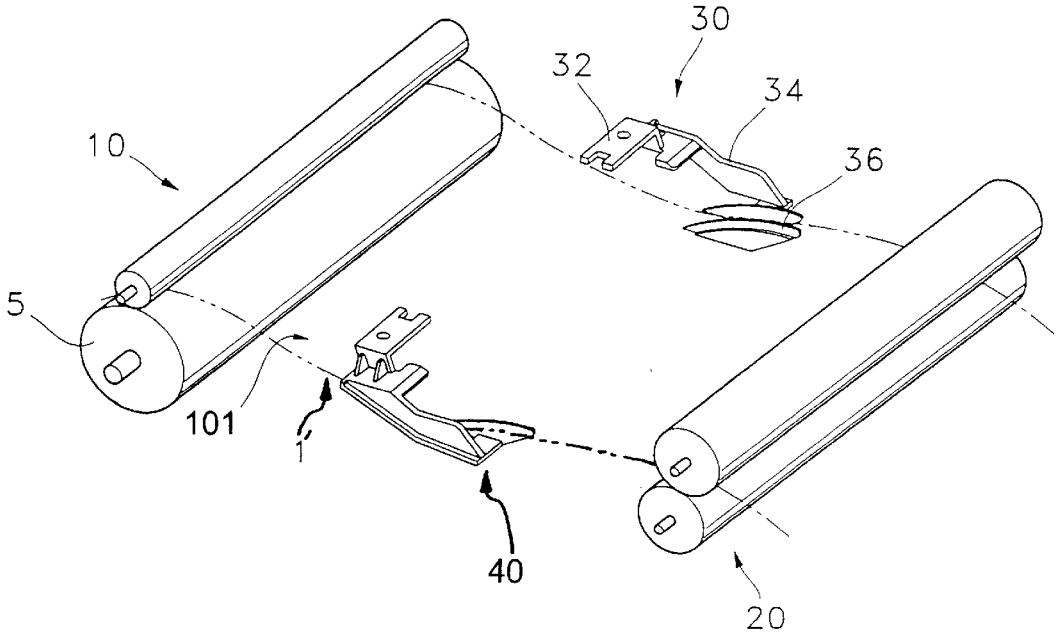
FIG. 4 is a perspective view of an apparatus for guiding a paper having an image formed on a surface thereof according to the present invention.

Hereinafter, an apparatus for guiding a paper for printing according to an embodiment of the present invention will be described in detail with reference to FIGS. 4 and 5. FIG. 4 is a perspective view of an apparatus for guiding a paper having an image formed on a surface thereof, according to the present invention. As shown in FIG. 4, the apparatus for guiding paper 101 has guide arm 30 and second guide arm 40 which are disposed between transferring device 10 and fixing device 20 of a printer to guide paper 101 while preventing surface 1', on which the image is formed, from being damaged.

According to the present invention, guide arm 30 and second guide arm 40 are mounted to be spaced roughly at a width of paper 101 from each other and to support the weight of paper 101. Each of guide arm 30 and second guide arm 40 according to the present invention includes bracket 32 which is fixed to a guide wall and which is located at a predetermined distance away from the surface of paper 101 opposite the surface containing the image (that is, on the side on which no image is formed), connecting section 34 connected with bracket 32 at an end of bracket 32, with connecting section 34 extended in the direction of motion of paper 101, and paper supports 36 which respectively are connected to the other end of connecting section 34 from where bracket 32 is joined, for guiding paper 101 by being in contact with side edges of surface 1', on which the image is formed. Preferably, paper supports 36 are integrated with bracket 32 and connecting section 34.

Bracket 32 is fixed by a screw to the guide wall which is disposed over the path in which paper 101 is carried, and connecting section 34 is extended to the path of paper 101. Furthermore, paper supports 36 are inwardly extended from the other end of connecting section 34.

According to the present invention, each paper support 36 has a knife edge to have a small area in contact with paper 101, resulting in reducing friction with paper 101. Preferably, paper supports 36 have an edge curved to be in correspondence with the path, or passageway, of paper 101.

Figure 5:
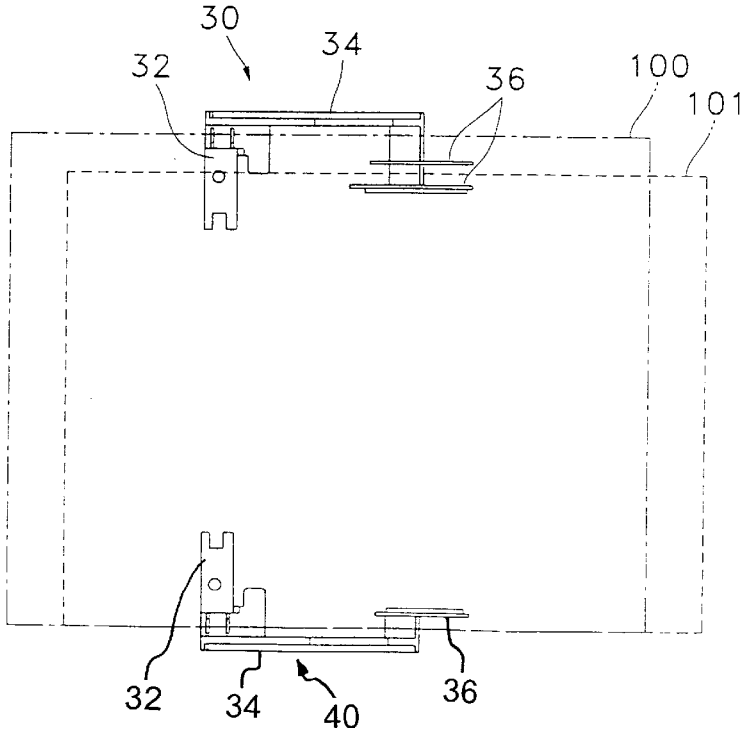
FIG. 5 is an overhead view of an apparatus for guiding a paper according to the present invention, illustrating the apparatus of the present invention guiding either of two types of papers having different sizes from each other.

As shown in FIG. 5, paper supports 36 are formed in parallel to each other at connecting section 34 so as to guide various types of papers having different size. Referring to FIG. 4, it is understood that two paper supports 36 are formed at connecting section 34 of guide arm 30 to guide different types of paper. In addition, in order to smoothly carry paper 101 by means of paper supports 36, an electrostatic device (not shown) may be mounted on an upper portion of paper supports 36 to support a weight of paper 101 by using static electricity.

Hereinafter, the operation of the apparatus for guiding the paper for printing according to the present invention will be described in detail with reference to FIG. 4. As shown in FIG. 4, in a case of a printer in which transferring drum 5 of transferring device 10 is disposed below paper 101, the image is formed on a lower surface 1' of paper 101. Paper 1 passing through transferring device 10 is guided by means of the guiding apparatus which is disposed between transferring device 10 and fixing device 20 such that the margin regions near the side edges of surface 1'; on which the image is formed, are supported by paper supports 36 of guide arm 30 and second guide arm 40, and paper 101 in turn is carried to fixing device 20.

At this time, since paper supports 36 support the area near the side edges of paper 101, paper 101 can be guided by the guiding apparatus and carried to fixing device 20 without contact between the image on surface 1' and paper supports 36. Paper 1 has a predetermined width of margin at the side edges thereof, on which the image is not formed. According, coming in contact with the area near the side edges of surface 1', paper supports 36 have no effect on the image. Furthermore, since the paper supports 36 have a knife edge shape and have a small area at an upper edge which is contacted to paper 101 and which is curved to be in correspondence with the path of paper 101, paper supports 36 have minimal friction with paper 1.

FIG. 5 is a perspective view of the apparatus for guiding a paper according to the present invention, in which the apparatus for guiding the paper guides two types of papers having different sizes from each other. As shown in FIG. 5, two paper supports 36 are formed on guide arm 30. Accordingly, two types of papers 100 and 101 having different widths can be guided by means of guide arm 30. Although FIG. 4 is shown with paper 101 for reasons of clarity, either paper can be used with the present invention, as shown in FIG. 5.

As described above, the apparatus for guiding the paper for printing according to the present invention can guide paper 101 or 100 without damage of the image on surface 1' of the paper. Therefore, an advantage of the present invention is that it is possible to obtain a high quality of the image which is formed on the surface of the paper for printing. While the present invention has been particularly shown and described with reference to a particular embodiment thereof, it will be understood by those skilled in the art that various changes in form and detail may be effected therein without departing from the scope of the invention as defined by the appended claims.

What is claimed is:

1. A paper guide for a printer, comprising:

a paper transport device, mounted in the printer;

a fixing unit, mounted in the printer at the same height as said paper transport device so as to receive a paper from said paper transport device, said paper transport device and said fixing unit defining a paper path between said paper transport device and said fixing unit, said paper path having a first side edge and a second side edge;

a paper support mounted in the printer so as to provide support slightly inside and underneath said first side edge of said paper path; and a second paper support mounted in the printer so as to provide support slightly inside and underneath said second side edge of said paper path.

2. The paper guide of claim 1, further comprising:

a third paper support mounted outside said first side edge of said paper path, so as to support an edge of a paper wider than that of said paper path.

3. The paper guide of claim 1, further comprising said first and second paper supports each having the shape of a knife blade having a blunt rounded edge, said paper supports each being oriented parallel to a side edge of said paper path and with said blunt rounded edge oriented upward.

4. The paper guide of claim 1, further comprising said paper supports being disposed so as to contact a paper moving in said paper path only along predetermined side margin regions of a paper moving in said paper path.

5. A paper guide for a printer, comprising:

a paper transport device, mounted in the printer;

a fixing unit, mounted in the printer at the same height as said paper transport device so as to receive a paper from said paper transport device, said paper transport device and said fixing unit defining a paper path between said paper transport device and said fixing unit, said paper path having a first side edge and a second side edge;

a first guide arm, comprising:

a bracket mounted to the printer above said first side edge of said paper path;

a connecting section attached to said bracket, extending outside said first side edge of said paper path and having an end underneath said paper path; and a paper support attached to said end of said connecting section, said paper support being disposed slightly inside and underneath said first side edge of said paper path; and a second guide arm, comprising:

a bracket mounted to the printer above said second side edge of said paper path;

a connecting section attached to said bracket of said second guide arm, extending outside said second side edge of said paper path and having an end underneath said paper path; and a paper support attached to said end of said connecting section of said second guide arm, said paper support being disposed slightly inside and underneath said second side edge of said paper path.

6. The paper guide of claim 5, further comprising said first guide arm comprising a second paper support attached to said end of said connecting section outside said first side edge of said paper path, so as to support an edge of a paper wider than that of said paper path.

7. The paper guide of claim 5, further comprising said paper support of said first guide arm and said paper support of said second guide arm each having the shape of a knife blade having a blunt rounded edge, said paper supports each being oriented parallel to a side edge of said paper path and with said blunt rounded edge oriented upward.

8. The paper guide of claim 5, further comprising said paper supports being disposed so as to contact a paper moving in said paper path only along predetermined side margin regions of a paper moving in said paper path.

9. The paper guide of claim 5, further comprising an electrostatic device mounted on an upper portion of one of said paper supports to support by static electricity a paper moving in said paper path.

* * * * *